US007044806B2

(12) United States Patent
Sian

(10) Patent No.: US 7,044,806 B2
(45) Date of Patent: May 16, 2006

(54) ELECTRICAL CONNECTOR TERMINAL POSITION ASSURANCE POLARIZATION

(75) Inventor: Sucha S. Sian, West Bloomfield, MI (US)

(73) Assignee: FCI America Technology, Inc., Reno, NV (US)

( * ) Notice: Subject to any disclaimer, the term of this patent is extended or adjusted under 35 U.S.C. 154(b) by 0 days.

(21) Appl. No.: 11/097,008

(22) Filed: Mar. 31, 2005

(65) Prior Publication Data

US 2005/0227548 A1 Oct. 13, 2005

Related U.S. Application Data

(60) Provisional application No. 60/561,056, filed on Apr. 9, 2004.

(51) Int. Cl.
*H01R 13/64* (2006.01)

(52) U.S. Cl. ..... 439/680; 439/752; 439/595

(58) Field of Classification Search ..... 439/595, 439/680, 752, 744
See application file for complete search history.

(56) References Cited

U.S. PATENT DOCUMENTS 5,730,625 A * 3/1998 Sikora ..... 439/595
6,045,404 A 4/2000 Myer ..... 439/595
6,056,604 A 5/2000 Roy et al. ..... 439/845
6,247,975 B1 6/2001 Cue ..... 439/845

FOREIGN PATENT DOCUMENTS

JP 09134756 A * 5/1997

* cited by examiner

*Primary Examiner*—Tho D. Ta
*Assistant Examiner*—Felix O. Figueroa
(74) *Attorney, Agent, or Firm*—Harrington & Smith,LLP

(57) ABSTRACT

An electrical connector including an electrical terminal; a housing member having the electrical terminal mounted therein; and a terminal position assurance (TPA) member. The housing member includes a deflectable latch which latches the electrical terminal inside the housing member. The TPA member is movably mounted on the housing member. The TPA member includes a blocking section adapted to substantially prevent deflection of the deflectable latch and at least one polarization section. The polarization section comprises a first polarizer and a second polarizer. The first polarizer is adapted to allow proper mounting of the TPA member relative to the housing member in only one position. The second polarizer is adapted to allow proper mounting of a mating electrical connector relative to the electrical connector in only one position.

17 Claims, 5 Drawing Sheets

ELECTRICAL CONNECTOR TERMINAL POSITION ASSURANCE POLARIZATION

CROSS REFERENCE TO RELATED APPLICATION

This application claims priority under 35 U.S.C. §119(e) to provisional patent application No. 60/561,056 filed Apr. 9, 2004 which is hereby incorporated by reference in its entirety.

BACKGROUND OF THE INVENTION

1. Field of the Invention

The present invention relates to an electrical connector and, more particularly, to an electrical connector having a terminal position assurance (TPA) member.

2. Brief Description of Prior Developments

U.S. Pat. No. 6,045,404, which is hereby incorporated by reference in its entirety, discloses a terminal position assurance (TPA) member used in an electrical connector. Electrical connectors are becoming increasingly small. There is a desire to provide an electrical connector having a TPA feature, but without significantly increasing the size of the connector. There is also a desire to provide a TPA member which functions as a polarizer for a mating electrical connector, and polarizing connection of the TPA member to the housing of the electrical connector. There is a desire to provide synchronized first and second polarizers on a TPA member which have cooperating shapes. There is a desire, by at least partially synchronizing the shapes of the first and second polarizers with each other, to provide the molding tooling required to produce the TPA member as a relatively simple design to manufacture and may have a longer working life because of the simplicity of the design.

SUMMARY OF THE INVENTION

An electrical connector can be provided with a terminal position assurance (TPA) member having a polarization feature for polarizing connection to a mating electrical connector, as well as polarizing connection to the housing of the electrical connector. The polarization feature can comprise an inward projection on the TPA which also forms synchronized recess on the exterior side of the TPA.

In accordance with one aspect of the present invention, an electrical connector is provided including an electrical terminal; a housing member having the electrical terminal mounted therein; and a terminal position assurance (TPA) member. The housing member includes a deflectable latch which latches the electrical terminal inside the housing member. The TPA member is movably mounted on the housing member. The TPA member includes a blocking section adapted to substantially prevent deflection of the deflectable latch and at least one polarization section. The polarization section comprises a first polarizer and a second polarizer. The first polarizer is adapted to allow proper mounting of the TPA member relative to the housing member in only one position. The second polarizer is adapted to allow proper mounting of a mating electrical connector relative to the electrical connector in only one position.

In accordance with another aspect of the present invention, an electrical connector is provided comprising a housing having at least one electrical contact latch; electrical contacts connected to the housing and retained by the at least one latch; and a terminal position assurance (TPA) member connected to the housing. The TPA member comprises a polarizer section which is sized and shaped to polarize connection of a mating electrical connector with the electrical connector to thereby limit connection of the electrical contacts to predetermined electrical contacts of the mating electrical connector.

In accordance with another aspect of the present invention, an electrical connector is provided comprising a housing having at least one electrical contact latch; electrical contacts connected to the housing and retained by the at least one latch; and a terminal position assurance (TPA) member connected to the housing. The TPA member comprises a housing receiving area with an inward protrusion into the housing receiving area and forming a recess along an exterior side of the TPA member.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
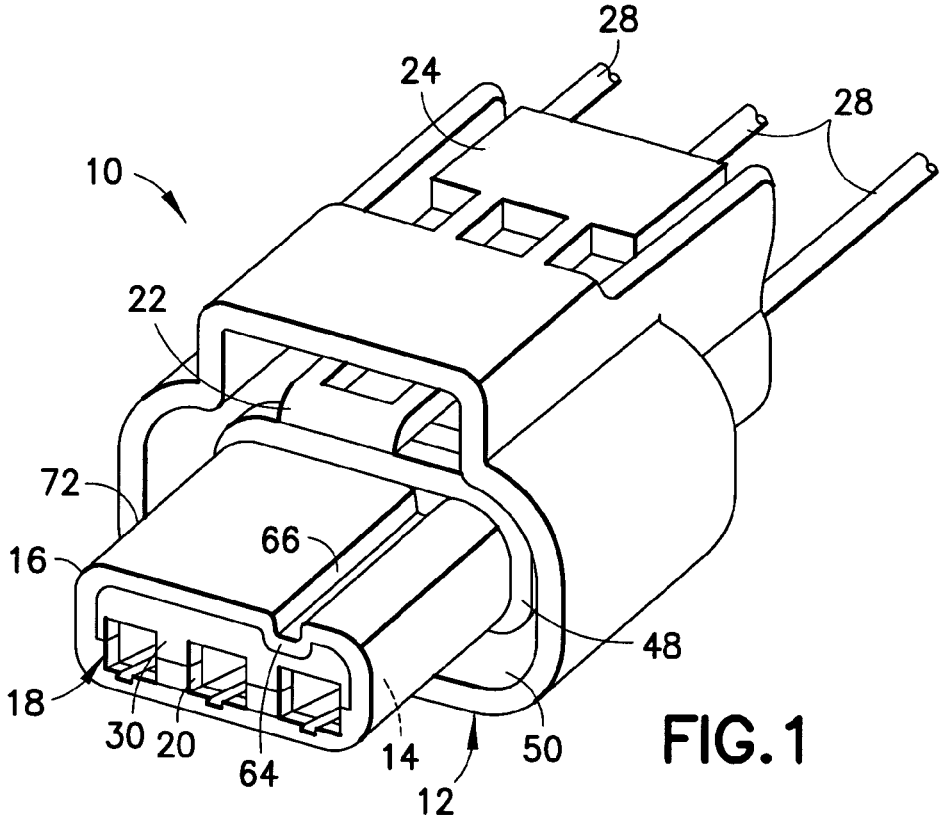
FIG. 1 is a perspective view of an electrical connector incorporating features of the present invention.

Referring to FIG. 1, there is shown a perspective view of an electrical connector 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

Figure 2:
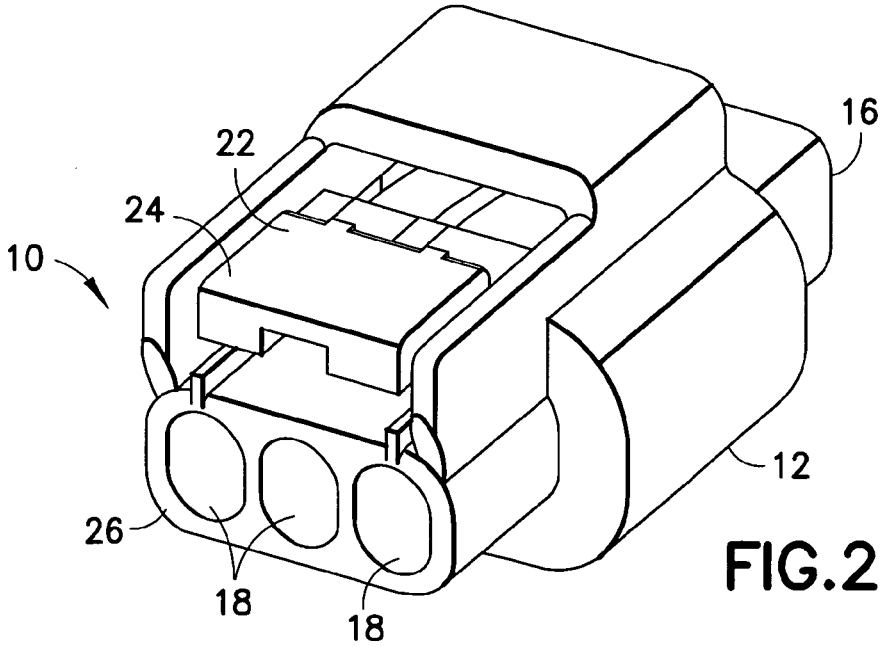
FIG. 2 is a perspective view of the electrical connector shown in FIG. 1 taken from an opposite direction.
Figure 3:
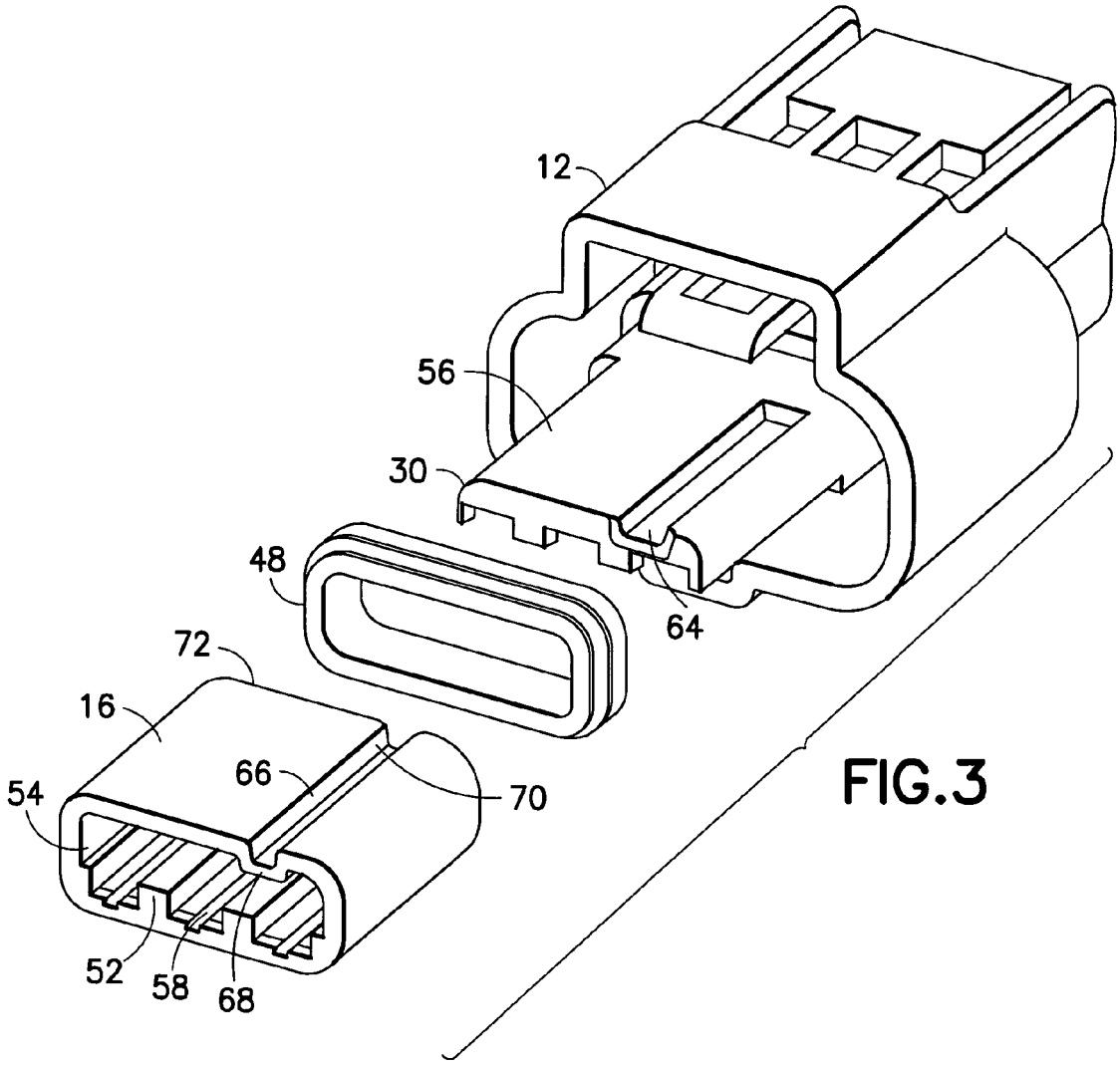
FIG. 3 is an exploded perspective view of the electrical connector shown in FIG. 1.
Figure 4:
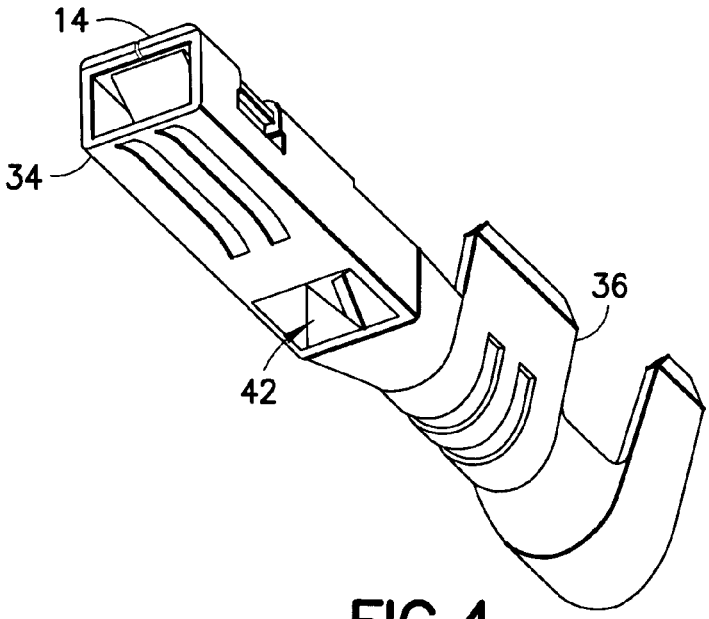
FIG. 4 is a perspective view of one of the electrical terminals used in the electrical connector shown in FIG. 1 (but not showing the electrical terminals)

Referring also to FIGS. 2–4, the electrical connector 10 generally comprises a housing 12, electrical terminals or contacts 14 mounted inside the housing 12, and a terminal position assurance (TPA) member 16 movably mounted to the housing 12. In the embodiment shown, the housing 12 comprises a one-piece molded plastic or polymer member. However, in alternate embodiments, the housing could be comprised of any suitable types of materials and could be comprised of more than one housing member. The housing 12 comprises a front end 20 which is adapted to be mated with a mating electrical connector (not shown). The housing 12 includes a pivotable latch 22 which is adapted to latch with the mating electrical connector. The latch 22 comprises a finger contact area 24 which allows a user to move the latch 22 to disengage the latch from the mating electrical connector. Any suitable type of latching system could be provided.

Figure 6:
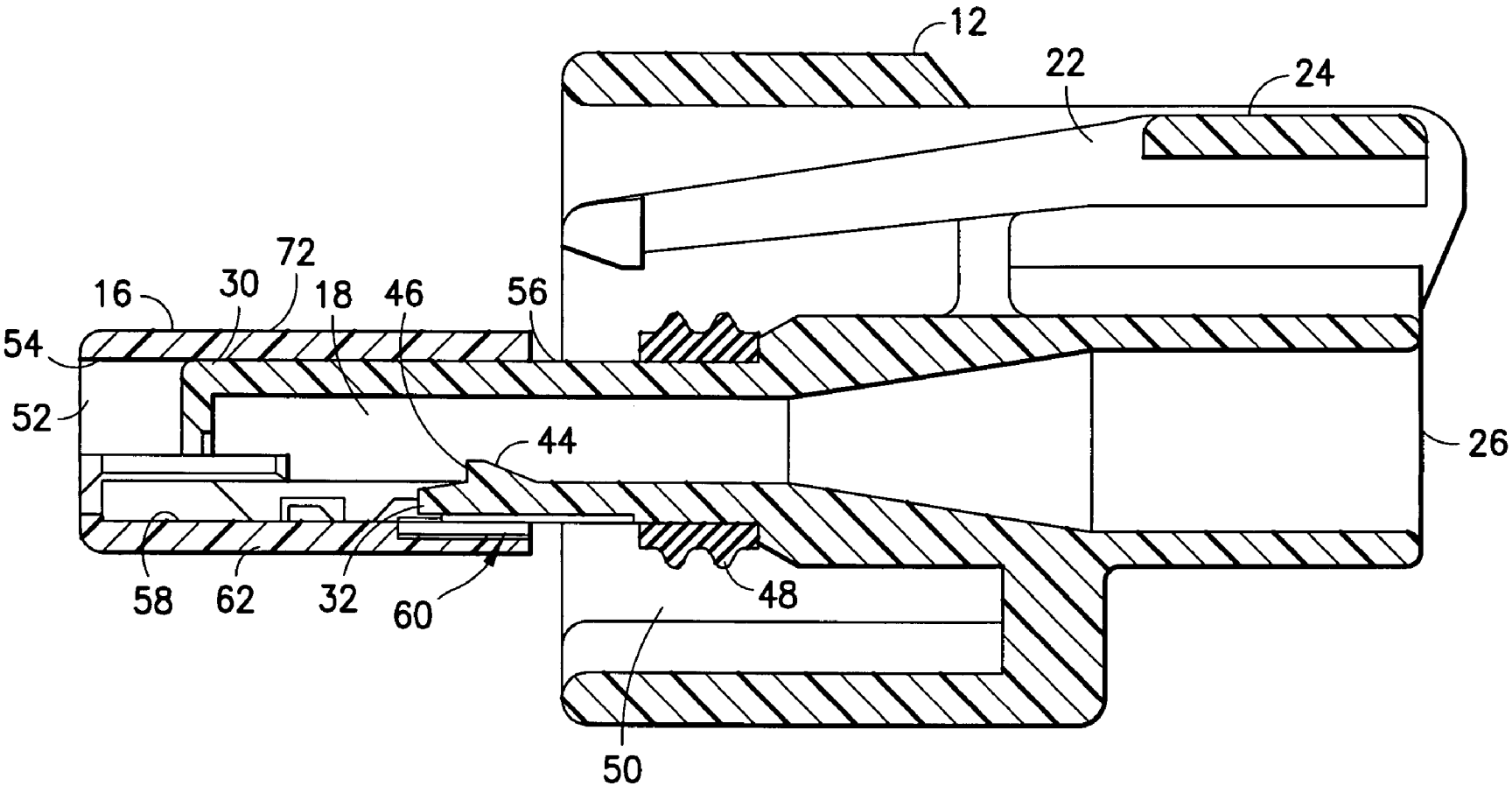
FIG. 6 is a cross sectional view of the electrical connector shown in FIG. 1 (but not showing the electrical terminals) with the TPA member in a pre-locked position.

In this embodiment, the electrical connector 10 comprises three of the terminals 14. However, in alternate embodiments, the electrical connector 10 could comprise more or less than three of the terminals. Referring also to FIG. 6, the housing 12 comprises three terminal receiving areas 18. The contacts 14 are not shown in FIGS. 6 and 7 merely for the sake of clarity. As seen in FIG. 2, the terminal receiving areas 18 have entrances at a rear end 26 of the housing 12. The terminals 14 are attached to wires 28 (see FIG. 1) and inserted through the rear end 26 of the housing into the terminal receiving areas 18.

In the embodiment shown, the housing 12 comprises a forward projecting section 30. The forward projecting section 30 forms a portion of the terminal receiving areas 18. The housing 12 also comprises deflectable latches 32 at a bottom side of the forward projecting section 30. When the electrical terminals 14 are inserted into the terminal receiving areas 18, the deflectable latches 32 are adapted to outwardly deflect to allow the terminals 14 to pass by the latches 32 and resiliently snap back to a latching position in latch receiving area 42. In the latching position, the deflectable latches 32 engage the electrical terminals 14 to prevent inadvertent withdrawal of the terminals 14 from the housing 12.

Referring particularly to FIG. 4, in the embodiment shown, the terminals 14 comprise a front female connection section 34 and a rear wire connection section 36. The rear wire connection section 36 is adapted to be folded or crimped onto a respective one of the electrical wires 28. The front female connection section 34 is adapted to removably receive a male contact section of an electrical contact in the mating electrical connector (not shown). Similar electrical terminals are disclosed in U.S. Pat. Nos. 6,247,975 and 6,056,604 which are hereby incorporated by reference in their entireties. However, in alternate embodiments, any suitable type of electrical terminals could be used.

Figure 5:
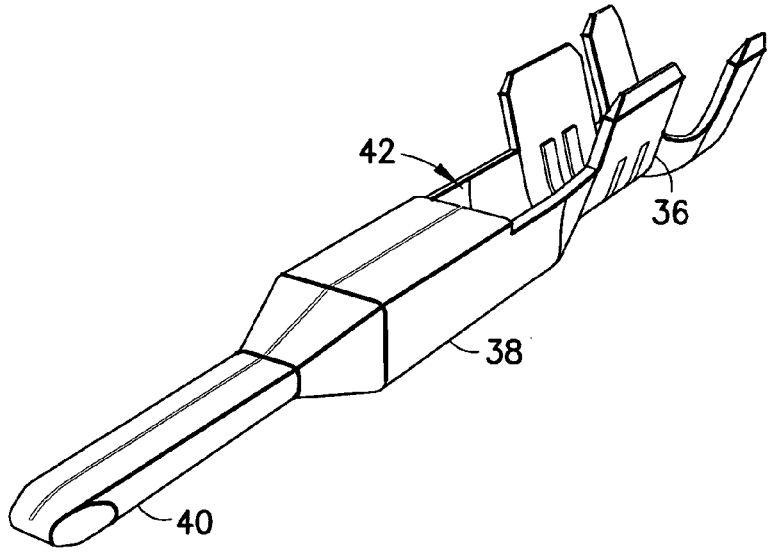
FIG. 5 is a perspective view of an alternate embodiment of an electrical terminal.

An alternate embodiment of the terminal 14 is shown in FIG. 5. In this embodiment, the electrical terminal 38 comprises a rear wire connection section 36 and a front male connection section 40. For both of the terminals 14, 38 shown, the terminals comprise a latch receiving area 42. The latch receiving areas 42 are adapted to receive a latching portion 44 of one of the deflectable latches 32. The latching portion 44 comprises a stop surface 46 which is adapted to engage a surface inside the latch receiving area 42 to prevent withdrawal of the terminals from the housing 12.

In the embodiment shown, the electrical connector 10 also comprises a seal 48 having a general ring shape. The seal 48 is mounted on the forward projecting section 30 and the TPA member 16 is then mounted on the forward projecting section 30. The seal 48 is adapted to be contacted by the housing of the mating electrical connector when a portion of the housing is inserted into the receiving area 50; to form a seal between the housing of the mating electrical connector and the housing 12.

Figure 7:
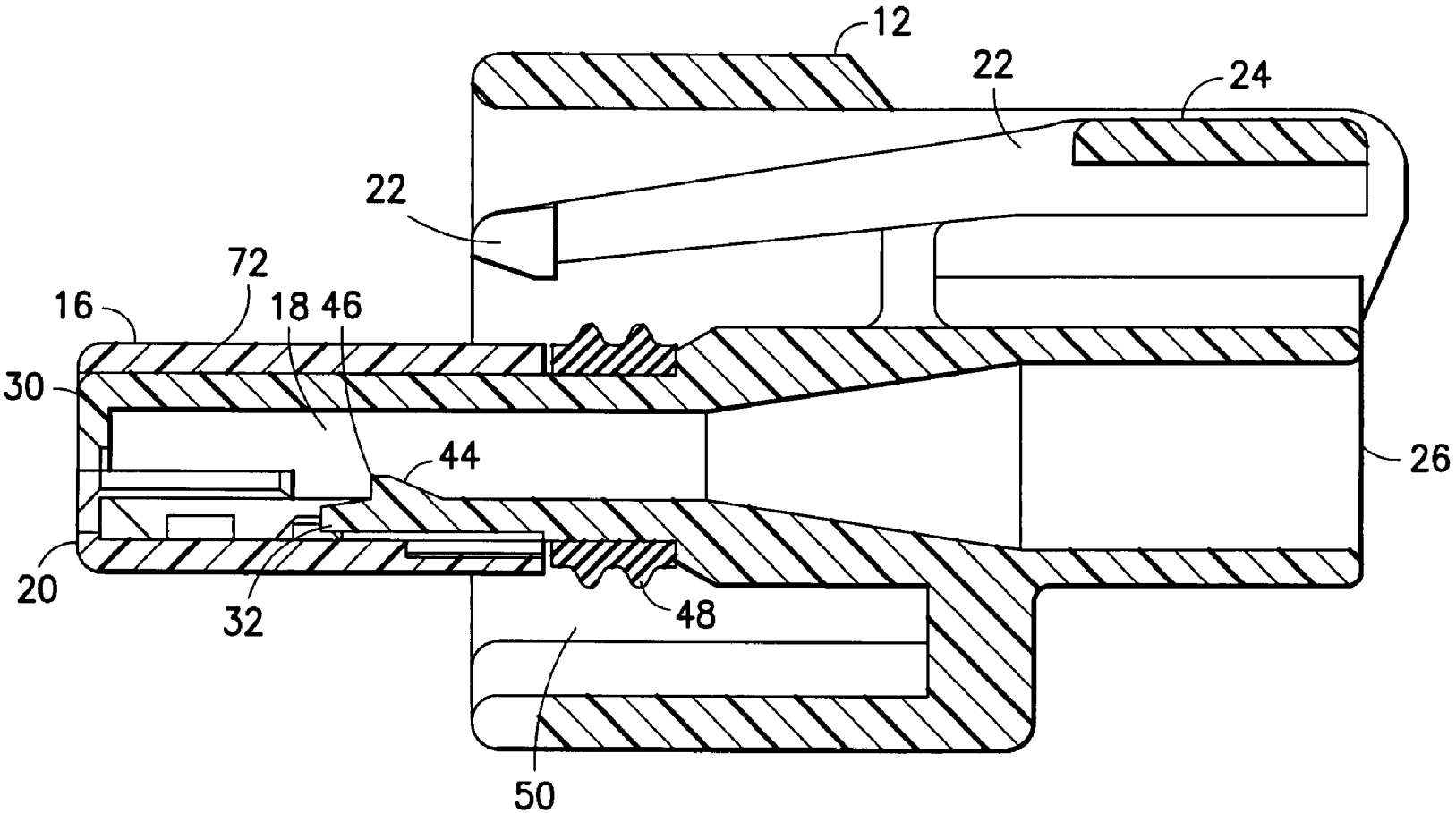
FIG. 7 is a cross sectional view as in FIG. 6 with the TPA member in a seated, locked position.

Referring particularly to FIGS. 1, 3, 6 and 7, the TPA member 16 has a general tubular sleeve shape. The TPA member 16 has an inner hole 52. A top side 54 of the inner surface at the hole 52 is located against the top side 56 of the forward projecting section 30. A bottom side 58 of the inner surface of the hole 52 is located at bottom sides of the terminal receiving areas 18. The TPA member 16 is slidably attached to the forward projecting section 30. The TPA member 16 has a forward pre-locked position as shown in FIG. 6 and a rearward, seated, locking position as shown in FIG. 7. As seen best in FIGS. 6 and 7, bottom portions of the TPA member 16 are located beneath the deflectable latches 32. The TPA member 16 comprises one or more recesses 60 proximate the bottom sides of the deflectable latches 32.

When the TPA member 16 is at its forward pre-locked position has shown in FIG. 6, the recess 60 is aligned beneath the front end of the deflectable latches 32. The recess 60 provides a space to enable the deflectable latches 32 to deflect outward or downward into the recess 60. Thus, in the forward pre-locked position, the TPA member 16 does not interfere with the outward or downward deflection of the deflectable latches 32. However, as seen in FIG. 7, when the TPA member 16 is moved to its seated, rearward locked position the recess 60 has been moved rearward such that it is no longer located beneath the front end of the deflectable latches 32. Instead, a full thickness wall section 62 of the TPA member is located beneath the front ends of the deflectable latches 32. This wall section 62 functions as a blocker to prevent the deflectable latches 32 from deflecting fully outward or downward and, thus, assures that the latches 32 retain the positions of the terminals 14 inside the terminal receiving areas 18. When in the pre-locked position, the portion of the TPA member 16 located beneath the recess 60 can also form an overstress protection for the deflectable latches 32.

Figure 8:
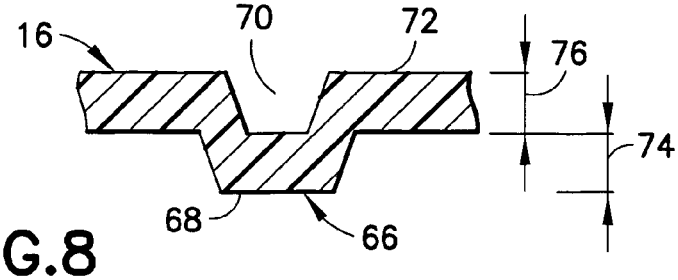
FIG. 8 is an enlarged cross sectional view of the polarization section of the TPA member.

Referring particularly to FIGS. 1, 3 and 8, the TPA member 16 has a front bottom side which, in cooperation with the front side of the forward projecting section 30, forms front entrances into the terminal receiving areas 18 for the contacts on the mating electrical connector (not shown). The top side 56 of the forward projecting section 30 of the housing 12 has a polarization section 64. In the embodiment shown, the polarization section 64 comprises a groove or recess in the top side 56. The TPA member 16 comprises a polarization section 66. The TPA polarization section 66 has a first polarizer 68 and a second polarizer 70. The first polarizer 68 is adapted to allow proper mounting of the TPA member 16 relative to the housing 12 in only one position. The second polarizer 70 is adapted to allow proper mounting of the mating electrical connector (not shown) relative to the electrical connector 10 in only one position.

In the embodiment shown, the first polarizer 68 is located on an inward facing side of the TPA member; the top side 54 of the hole 52. The second polarizer 70 is located on an outward facing side of the TPA member 16. The first and second polarizers 68, 70 are located at opposite sides of a same wall of the TPA member 16 directly opposite each other. More specifically, the first and second polarizers 68, 70 are formed by a wall irregularity in the TPA member 16 forming a substantially synchronized protrusion forming the first polarizer 68 and recess forming the second polarizer 70. The TPA member also has a polarizing flat extending along a majority of a width of the top side of the TPA member and adjacent the inward protrusion. The thickness of the wall of the TPA member 16 is substantially uniform along the top side or top wall 72 of the TPA member.

The first polarizer 68 projects into the hole 52. The first polarizer 68 mates with the polarization section 64 of the housing 12. More specifically, the projection of the first polarizer 68 is located in the recess or groove of the housing's polarization section 64. The projection 68 can slide in the groove 64. The first polarizer 68 prevents the TPA member 16 from being attached to the forward projecting section 30 in a reversed or flipped orientation. Thus, the first polarizer 68, cooperating with the housing's polarization section 64, insurers that the recess 60 can be located beneath the front end of the deflectable latches 32. Otherwise, if the TPA member 16 was installed in a reversed or flipped orientation, the electrical terminals 14 would not be able to be fully inserted and locked in the terminal receiving areas 18 and, could not be removed from the terminal receiving areas 18; such as for servicing, replacement, or repair.

The second polarizer 70 is adapted to receive a polarizing projection (not shown) on the housing of the mating electrical connector. The second polarizer 70 cooperates with the polarizing projection of the mating electrical connector to ensure that the mating electrical connector is attached to the electrical connector 10 in a proper orientation without being reversed or flipped. This insures that the position of the contacts (not shown) of the mating electrical connector are aligned with the electrical terminals 14 for proper connection between the contacts and terminals without misalignment problems. This also insures that the latch of the mating electrical connector will properly latch with the latch 22 of the housing 12.

One of the features of the present invention is providing the first and second polarizers 68, 70 at the same portion of the top wall 72 of the TPA member 16. In some environments or applications, the electrical connector 10 is substantially small in size. Thus, an increase in size of the electrical connector is not desired. Increasing the size of the electrical connector 10, or a portion of the electrical connector 10 which mates with the mating electrical connector, can also result in the mating electrical connector needing to be increased in size. With the present invention, the size of the electrical connector 10 does not need to be increased, and perhaps can be decreased, by providing the synchronized first and second polarizers 68, 70 in the cooperating shape shown. By at least partially synchronizing the shapes of the first and second polarizers with each other, the molding tooling required to produce the TPA member is relatively simple to manufacture and may have a longer working life because of the simplicity of this novel design.

As seen with reference to 58, the thickness 74 of the wall 72 at the polarization section 66 can be about the same thickness 76 as the rest of the wall 72. In the embodiment shown, the groove formed by the second polarizer 70 can have a depth equal to or greater than the thickness 76. Thus, the polarization projection on the mating electrical connector can extend a substantial distance through the wall 72 and, perhaps, past the flat top section of the top surface 56 of the forward projecting section 30 of the housing 12. In alternate embodiments, the groove 70 could have any suitable depth into the wall 72. With the present invention, the outer perimeter of the TPA member 16 does not need to be increased to accommodate its mating electrical connector polarizer 70 and, provides a housing polarizer 68. This insures proper connection of the TPA member 16 to the housing 12 and proper connection of the electrical connector 10 to the mating electrical connector without the need to increase the size of the electrical connector 10 or the mating electrical connector, or components thereof.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

an electrical terminal;

a housing member having the electrical terminal mounted therein, wherein the housing member comprises a deflectable latch which latches the electrical terminal inside the housing member; and a terminal position assurance (TPA) member movably mounted on the housing member, wherein the TPA member comprises a blocking section adapted to substantially prevent deflection of the deflectable latch and at least one polarization section, wherein the polarization section comprises a first polarizer and a second polarizer, wherein the first polarizer is adapted to allow proper mounting of the TPA member relative to the housing member in only one position, wherein the second polarizer is adapted to allow proper mounting of a mating electrical connector relative to the electrical connector in only one position, wherein the polarization section is formed at a side wall of the TPA member with a groove along an exterior side of the side wall and an inward protrusion formed at an interior side of the side wall at the groove, wherein the inward protrusion forms the first polarizer and the groove forms the second polarizer, and wherein the first and second polarizers are formed by a wall irregularity in the side wall of the TPA member such that the recess and protrusion are substantially longitudinally synchronized with each other.

2. An electrical connector as in claim 1 wherein the groove and inward protrusion extend along an entire length of the TPA member from a front end to a rear end.

3. An electrical connector as in claim 1 wherein the side wall comprises a top side wall of the TPA member generally perpendicular to a front end of the TPA member.

4. An electrical connector comprising:

a housing having at least one electrical contact latch;

electrical contacts connected to the housing and retained by the at least one latch; and a terminal position assurance (TPA) member connected to the housing, wherein the TPA member comprises a polarizer section which is sized and shaped to polarize connection of a mating electrical connector with the electrical connector to thereby limit connection of the electrical contacts to predetermined electrical contacts of the mating electrical connector, wherein the TPA member comprises a housing receiving area with an inward protrusion into the housing receiving area, wherein the protrusion forms a recess along an exterior side of the TPA member, and wherein the inward protrusion forms the first polarizer and the recess forms the second polarizer.

5. An electrical connector as in claim 4 wherein the TPA member is slidably movable on the housing.

6. An electrical connector as in claim 4 wherein the TPA member comprises a general loop shape and is mounted over a projecting section of the housing.

7. An electrical connector as in claim 4 wherein the housing comprises a projecting section located in the housing receiving area of the TPA member, and wherein the housing comprises a groove which receives the inward protrusion.

8. An electrical connector as in claim 4 wherein the polarizer section comprises means for polarizing connection of the polarizer section with the housing and means for polarizing connection of the polarizer section with the mating electrical connector, and wherein the two polarizing means comprise a common feature on the TPA member.

9. An electrical connector as in claim 4 wherein the polarizer section comprises a top side of the TPA member comprising a polarizing flat extending along a majority of a width of the top side and an adjacent protrusion extending inwardly from the top side.

10. An electrical connector as in claim 9 wherein the top side has a substantially uniform thickness.

11. An electrical connector comprising:

a housing having at least one electrical contact latch;

electrical contacts connected to the housing and retained by the at least one latch; and a terminal position assurance (TPA) member connected to the housing, wherein the TPA member comprises a housing receiving area with an inward protrusion into the housing receiving area, wherein the housing is located at least partially in the housing receiving area, and wherein the inward protrusion forms a recess along an exterior side of the TPA member adapted to receive a portion of a housing of a mating electrical connector.

12. An electrical connector as in claim 11 wherein the TPA member is slidably movable on the housing.

13. An electrical connector as in claim 11 wherein the TPA member comprises a general loop shape with a generally open front end, and wherein the TPA member is mounted over a projecting section of the housing.

14. An electrical connector as in claim 11 wherein the housing comprises a projecting section located in the housing receiving area, and wherein the housing comprises a groove which receives the inward protrusion.

15. An electrical connector as in claim 11 wherein the TPA member comprises means for polarizing connection of the TPA member with the housing and means for polarizing connection of the TPA member with a mating electrical connector, and wherein the two polarizing means comprise the inward protrusion on the TPA member.

16. An electrical connector as in claim 11 wherein the exterior side is located on a top side of the TPA member and the top side comprises a polarizing flat extending along a majority of a width of the top side adjacent the inward protrusion which extends inwardly from the top side.

17. An electrical connector as in claim 16 wherein the top side has a substantially uniform thickness.

* * * * *